US006306260B1

(12) United States Patent
Kawashima

(10) Patent No.: US 6,306,260 B1
(45) Date of Patent: Oct. 23, 2001

(54) WET WEB TRANSFER BELT

(75) Inventor: Shin Kawashima, Abiko (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/615,895

(22) Filed: Jul. 14, 2000

(30) Foreign Application Priority Data

Jul. 19, 1999 (JP) ..... 11-205462

(51) Int. Cl.[7] ..... D21F 3/00

(52) U.S. Cl. ..... 162/306; 162/358.4; 162/901; 442/270; 442/274

(58) Field of Search ..... 162/358.2, 358.3, 162/358.4, 900, 902, 901, 306; 28/110, 112; 442/225, 323, 324, 268, 270, 271, 388, 400, 274, 275; 198/844.1

(56) References Cited

U.S. PATENT DOCUMENTS 4,259,394 * 3/1981 Khan ..... 442/191
4,565,735 * 1/1986 Murka, Jr. et al. ..... 428/234
4,806,413 * 2/1989 Penven ..... 428/222
5,298,124 * 3/1994 Eklund et al. ..... 162/306
5,863,390 * 1/1999 Matsuno ..... 162/358.2
6,036,819 * 3/2000 Miller et al. ..... 162/358.2

FOREIGN PATENT DOCUMENTS 88193 5/1985 (JP) ..... D21F/7/08
57678 3/1994 (JP) ..... D21F/3/00

* cited by examiner

*Primary Examiner*—Peter Chin
*Assistant Examiner*—Eric Hug
(74) *Attorney, Agent, or Firm*—Howson & Howson

(57) ABSTRACT

A wet web transfer belt for a closed draw papermaking machine is provided with a rough surface to allow easy release of a wet web. The rough surface is obtained easily, and with reliable quality, by forming the web-contacting side of a batt layer from a welded layer of meltable fiber.

6 Claims, 7 Drawing Sheets

FIG. 7

| | Composition | | | Density | Air Permeability | Surface Roughness | Light-weighted-ness | Rewetting Preven-tion | Releas-ability |
|---|---|---|---|---|---|---|---|---|---|
| | Batt Layer 3a | Batt Layer 3b | Base | | | | | | |
| Example 1 | A Melta-ble 100%<br>B Melta-ble 100% | Melta-ble 80%<br>Univ. 20% | Upper 1/1 Plain weave 200g/m$^2$ | 1 | less than 1 | 20 | △ | ◎ | ○ |
| Example 2 | A Melta-ble 100%<br>B Melta-ble 80%<br>Univ. 20% | Melta-ble 80%<br>Univ. 20% | | 0.95 | less than 1 | 20 | △ | ◎ | ○ |
| Example 3 | A Melta-ble 90%<br>Univ. 10%<br>B Melta-ble 80%<br>Univ. 20% | Melta-ble 70%<br>Univ. 30% | Lower 1/3 3/1 broken | 0.90 | less than 1 | 26 | ○ | ◎ | ○ |
| Example 4 | A Melta-ble 80%<br>Univ. 20%<br>B Melta-ble 80%<br>Univ. 20% | Melta-ble 80%<br>Univ. 20% | Double weave 400g/m$^2$ | 0.85 | 1~2 | 30 | ◎ | ○ | ◎ |
| Example 5 | A Melta-ble 80%<br>Univ. 20%<br>B Melta-ble 80%<br>Univ. 20% | Univ. 100% | | 0.85 | 1~2 | 30 | ◎ | ○ | ◎ |
| Example 6 | A Melta-ble 90%<br>Univ. 5%<br>Heat-r. 5%<br>B Melta-ble 80%<br>Univ. 20% | Melta-ble 80%<br>Univ. 20% | | 0.80 | 1~2 | 35 | ◎ | ○ | ◎ |
| Example 7 | A Melta-ble 80%<br>Univ. 15%<br>Heat-r. 5%<br>B Melta-ble 80%<br>Univ. 20% | Melta-ble 80%<br>Univ. 20% | | 0.75 | 1~2 | 40 | ◎ | ○ | ◎ |
| Example 8 | A Melta-ble 30%<br>Univ. 70%<br>B Univ. 100% | Melta-ble 100% | | 0.65 | 2 | 50 | ◎ | △ | ◎ |

FIG. 8

| | Composition | | | Density | Air Permeability | Surface Roughness | Light-weighted-ness | Rewetting Preven-tion | Releas-ability |
|---|---|---|---|---|---|---|---|---|---|
| | Batt Layer 3a | Batt Layer 3b | Base | | | | | | |
| Comp. 8 | A Univ. 100%<br>B Melta-ble 80%<br>Univ. 20% | Melta-ble 80%<br>Univ. 20% | Upper 1/1 Plain weave 200g/m$^2$<br>Lower 1/3 3/1 broken Double weave 400g/m$^2$ | 0.70 | 2 | 80 | ◎ | × | ◎ |
| Comp. 9 | A Melta-ble 20%<br>Univ. 80%<br>B Melta-ble 100% | Univ. 100% | | 0.60 | 4 | 70 | ◎ | × | ◎ |
| Comp. 10 | A Univ. 100%<br>B Univ. 100% | Univ. 100% | | 0.65 | 5 | 100 | ◎ | × | ◎ |
| Comp. 11 | Polyurethane resin coating (2600g/m$^3$) | None | Double weave (1000g/m$^2$) | 1.06 | 0 | 30 | × | ◎ | ○ |
| Conv. 12 | | | | | | | | | |

WET WEB TRANSFER BELT

FIELD OF THE INVENTION

This invention relates to papermaking, and more particularly to a wet web transfer belt in a papermaking machine, wherein a wet web is transferred in a closed draw.

BACKGROUND OF THE INVENTION

In a conventional papermaking machine wherein a wet web is transferred in open draw, that is, the wet web is transferred without a support, the web is susceptible to rupture at the transfer points. The possibility of rupture places a limitation on the speed at which the papermaking machine may be run. Consequently, closed draw papermaking machines, i.e. machines in which the web is transferred with a support, are becoming more prevalent. The closed draw machines can be operated stably at higher speeds.

In a conventional closed draw papermaking machine, a pickup felt picks up a wet web from a preceding section of the machine, holding the web underneath the bottom surface of the felt and transferring it to a next stage transfer belt.

The wet web is then pinched between the pickup felt and a transfer belt at a first nip formed between a pair of press rolls. Water is squeezed out of the wet web at the first nip. The wet web is then released from the pickup felt and transferred to the transfer belt. The transfer belt carries the wet web to a second nip formed between a third press roll and a shoe press, where further water is drained from the web and picked up by a press felt.

The wet web remains on the transfer belt until it reaches a vacuum roll, where the web is transferred to a canvas belt for heating and drying.

The closed draw papermaking apparatus utilizes a number of transfer points. Therefore, it is important for the wet web to be released easily to avoid maloperation. It is especially important for the wet web to be released easily at the location immediately following the shoe press because, if the transfer belt is smooth, a continuous film of water is likely to be formed between the wet web and the transfer belt. The water film can cause the wet web to adhere so tightly to the transfer belt that it cannot be released, even by the force applied by the vacuum roll.

The problem of web releasability has been addressed by utilizing the technology disclosed in Japanese published unexamined patent applications 57678/1994 and 88193/1985.

In the case of application 57678/1994 a filler is mixed into a synthetic resin layer formed on the surface of a base layer. The synthetic resin layer is ground after the resin has cured, and the filler forms projections on its surface. These projections impart a roughness to the surface and are very effective in breaking up the water film formed between the web and the transfer belt.

In the case of application 88193/1985, a synthetic resin layer 32 is applied to the surface of a base layer 31 by spraying in such a way that numerous air bubbles are formed in the synthetic resin layer. Upon grinding of the synthetic resin layer after it is cured, the air bubbles at the surface produce a multitude of concavities. These concavities impart a roughness to the surface of the belt which is effective to break the water film between the transfer belt and a wet web carried thereby.

The projections and concavities on the surfaces of the belts of the prior art can be formed only by grinding the surface of the synthetic resin layer after it has been cured.

The need for curing and grinding results in a high production cost. In the case of the prior art belt utilizing a filler, because of the hardness of the filler particles, the projections are likely to impart markings to the wet web. In both cases, the prior art belts, which are composed of a base layer and a synthetic resin layer, tend to be heavy and difficult to install in a papermaking machine, depending on the structure and surroundings of the machine.

This invention addresses the above-mentioned problems. An important object of the invention, therefore, is to provide a wet web transfer belt in which a rough surface, permitting easy release of a wet web at transfer points in a closed draw papermaking machine, can be produced easily. Still another object of the invention is to enable the production of a wet web having a rough surface of reliable quality. It is also an object of the invention to produce, on a wet web transfer belt, a rough surface which does not produce markings on the wet web.

SUMMARY OF THE INVENTION

The invention achieves the aforementioned objects in a wet web transfer belt for a papermaking machine wherein a wet web is transferred in a closed draw, the belt comprising a base layer and a batt layer, wherein the at least a surface of the side of the batt layer on which the wet web is placed is formed of fiber comprising a welded layer of meltable fiber. The fiber forming the surface of the batt layer can consist substantially entirely of a meltable fiber, in which case the desired surface roughness can be obtained with a reliable quality by regulating the heat in welding the meltable fibers. Alternatively the fiber forming the surface of the batt layer surface can comprise a mixture of a meltable fiber and a non-meltable (universal) fiber. In the latter case, the desired surface roughness can be achieved by regulating the heat in welding, or by regulating the relative proportions of meltable fiber and non-meltable fibers in the surface of the batt layer.

Preferably, at least a part of the meltable fiber is meltable at a temperature in the range from 120° C. to 180° C., and the meltable fiber of the welded layer partly retains a fibrous configuration.

In a preferred embodiment, in order to prevent rewetting by keeping water from migrating deep into the belt, the welded layer has an air permeability of 2 cc/cm$^2$/sec. or less.

The preferred surface roughness of the welded layer is in the range of Rz5–80 $\mu$m in order that the water film formed between the wet web and the belt can be broken easily and the wet web can be released easily from the belt after it emerges from the nip press.

Other objects, details and advantages of the invention will be apparent from the following detailed description when read in conjunction with the drawings.

BRIEF DESCRIPTION OF THE DRAWINGS

FIG. 5(*b*) is a similar view, illustrating the application of pressure to the wet web;

FIG. 5(*c*) is a similar view illustrating the condition of the wet web after pressure is released;

FIG. 7 is a table summarizing the performance of working examples 1–8;

FIG. 8 is a table summarizing the performance of comparative examples 9–11;

FIG. 9(*b*) is an enlarged cross-sectional view of a conventional belt in which a filler is mixed into a synthetic resin layer; and FIG. 9(*c*) is an enlarged cross-sectional view of a conventional belt in which air bubbles are mixed into a synthetic resin layer.

DETAILED DESCRIPTION

Figure 9A:
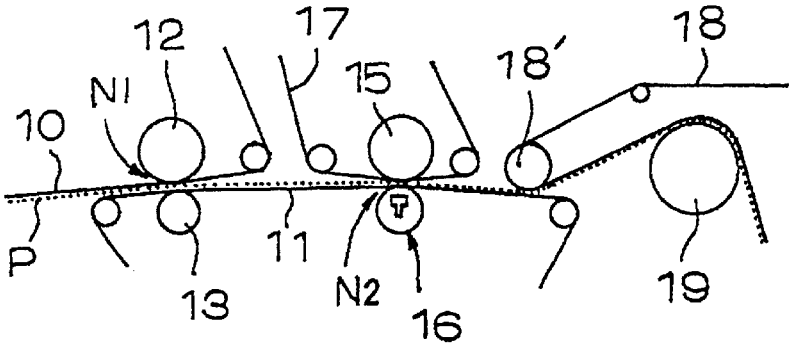
FIG. 9(*a*) is a schematic view of a closed-draw papermaking machine.
Figure 9B:
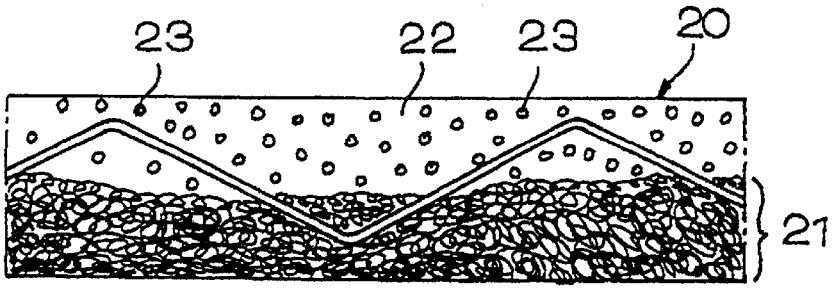
FIG. 9B PRIOR ART
Figure 9C:
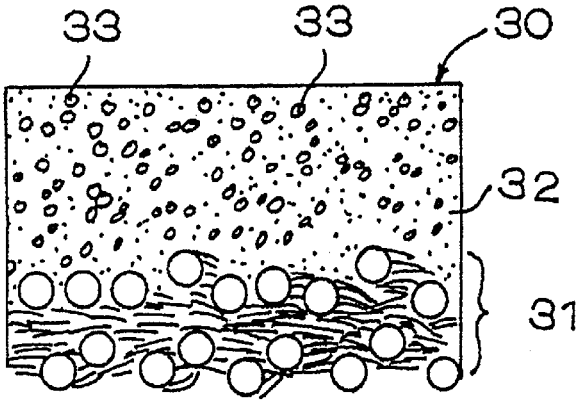
FIG. 9C PRIOR ART

FIG. 9(*a*) shows the main part of a closed draw papermaking machine. A pickup felt 10 picks up a wet web P from a preceding section of the machine, for example the wire section (not shown), holding the web underneath the bottom surface of the felt and transferring it to a next stage transfer belt 11. The pickup felt therefore functions as a support for the wet web P.

The wet web P is pinched between the pickup felt 10 and the transfer belt 11 at a first nip N1 formed between first and second press rolls 12 and 13. Pressure is applied to the wet web at the nip N1, squeezing water out of the wet web. After passing through the first nip N1, the wet web P is released from the pickup felt 10 and transferred to the web transfer belt 11. The belt 11, in turn, carries the wet web to a second nip N2, formed between a third press roll 15 and a shoe press 16. The pressure applied to the wet web P at nip N2 further drains water from the web. The water squeezed out of the wet web at nip N2 moves to a press felt 17.

When pressure is released from the wet web P after it passes through nip N2, the wet web remains on transfer belt 11 until it reaches vacuum roll 18'. At the vacuum roll, the web is transferred, by a vacuum applied inside the vacuum roll, to a canvas belt 18, which passes around the vacuum roll. While on the canvas belt, the web is heated and dried by a heating cylinder 19.

Especially at the location immediately following the shoe press, i.e., the location following the second nip N2, if the transfer belt 11 is smooth, a continuous film of water is likely to be formed between the wet web P and the transfer belt. The water film can cause the wet web P to adhere so tightly to the belt 11 that it cannot be released from belt 11, even by the force applied by the vacuum roll 18'.

A belt disclosed in Japanese published application 57678/1994 is depicted in FIG. 9(*b*) as belt 20. In this belt, a filler 23 is mixed into a synthetic resin layer 22 formed on the surface of a base layer 21. The filler has a hardness greater than that of the synthetic resin. When the layer 22 is ground after the synthetic resin has cured, the filler forms projections on the surface of the layer 22. These projections impart a roughness to the surface of layer 22 and are very effective in breaking up the water film formed between the web and the transfer belt.

A belt disclosed in Japanese published application 88193/1985 is depicted in FIG. 9(*c*) as belt 30. A synthetic resin layer 32 is applied to the surface of a base layer 31 by spraying in such a way that numerous air bubbles 33 are formed in the synthetic resin layer. Upon grinding of the synthetic resin layer after it is cured, the air bubbles at the surface produce a multitude of concavities. These concavities impart a roughness to the surface of the belt which is effective to break the water film between the transfer belt and a wet web carried thereby.

As mentioned previously, the projections and concavities on the surfaces of the belts of the prior art can be formed only by grinding the surface of the synthetic resin layer after it has been cured. The need for curing and grinding results in a high production cost. In the case of the prior art belt utilizing a filler, because of the hardness of the filler particles, the projections are likely to impart markings to the wet web. In both cases, the prior art belts, which are composed of a base layer and a synthetic resin layer, tend to be heavy and difficult to install in a papermaking machine, depending on the structure and surroundings of the machine.

Several embodiments of the invention will now be described with reference to FIGS. 1–7.

Figure 1:
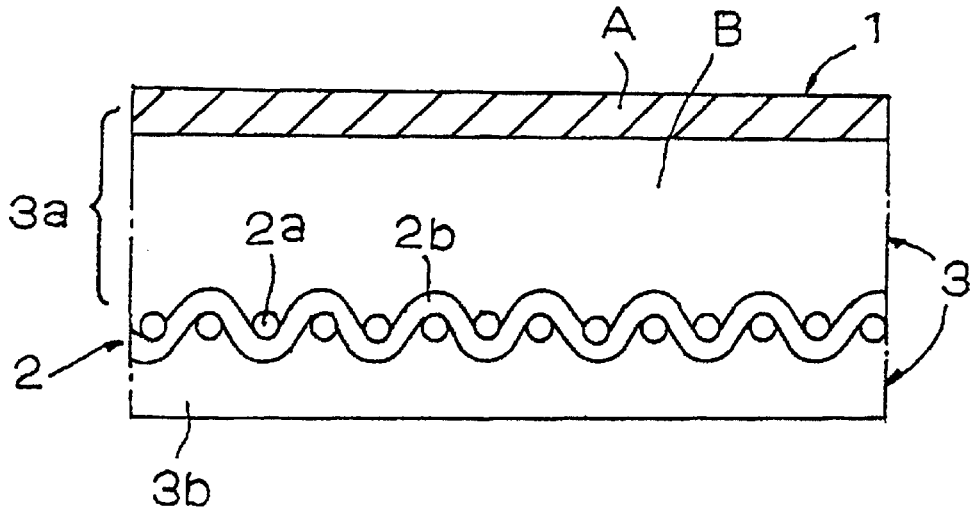
FIG. 1 is an enlarged cross-sectional view of a wet web transfer belt in accordance with a first embodiment of the invention, in which a meltable fiber is used only in the surface layer of the side on which a wet web is placed.

In FIG. 1, the transfer belt of the invention, generally referred to by reference numeral 1, comprises a base layer 2 and a batt layer 3. The batt layer 3 is intertwined and integrated into the base layer 2 by needle punching. The base layer 2 consists of a ground fabric having a woven structure made up of a warp yarn 2*a* and a weft yarn 2*b*. Monofilament single yarns, monofilament twisted yarns, and multifilament yarns may be used as the warp yarns and as the weft yarns. The woven structure can be a single weave, a double weave or a triple weave selected singly or provided in a piled combination. The base layer preferably has a basic weight of 300–800 g/m$^2$.

The batt layer 3 is composed of two sides: a side 3*a* on which a wet web is placed and a roll contact side 3*b* which is contacted by the press roll of a papermaking machine. Preferably, the total basic weight of the batt layer 3 is 600–1200 g/m$^2$. It is preferable that the basic weight and apparent density of a completed belt according to the invention be regulated to 900–2000 g/m$^2$ and 0.40–0.99 g/cm$^3$, respectively.

In the transfer belt 1 shown in FIG. 1, at least the surface layer A (the cross-hatched part of side 3*a*, on which the wet web is placed) is formed either substantially entirely of a meltable fiber, or of a mixture of a meltable fiber and a non-meltable fiber. The middle layer B, as well as the roll-contacting side 3*b* are composed of a non-meltable fiber.

The term "meltable fiber" as used herein refers to a fiber the whole or a part of which is melted at a temperature in the range from 120° C.–180° C. For example, a copolymerized nylon, which includes nylon 11, nylon 12, nylon 6 and nylon 66, etc. may be used. On the other hand the term "non-meltable fiber" refers to a fiber which is not meltable in the temperature range in which the meltable fiber is melted. For instance, universal fibers and heat-resistant fibers which are generally used in conventional press felts are "non-meltable fibers." It is preferable that the heat-resistant fibers have a melting point higher than that of universal fibers by 20° C.

or more. Specifically, PPS, PEEK, PEK, all aromatic polyesters and aromatic polyamides, etc. which have melting points of 280° C. or higher can be employed either alone or in mixtures.

If a welded layer is formed after the meltable fiber at surface A is welded by heat, the air permeability of side 3*a* is reduced. Therefore, less water permeates into the belt 1, effectively preventing the phenomenon of rewetting.

In the case of a layer A consisting substantially entirely of meltable fiber, if the meltable fiber is melted completely, the fibrous configuration is lost, and the air permeability of side 3*a* becomes zero. This prevents rewetting, and also makes the surface of the belt very smooth, which is useful for making high quality paper. However, complete melting is not preferred because it prevents the wet web from being released easily. It is important not to melt the meltable fiber completely, so that the fibrous configuration is retained to some extent and projections and concavities are formed on the side 3*a* on which the wet web is placed.

If the surface layer A on side 3*a* is made of a mixture of a meltable and a non-meltable fiber, the non-meltable fiber remains as a fiber without melting even if heat is such that the meltable fiber melts completely. Therefore in the case of a mixture of meltable and non-meltable fibers, projections and concavities can be formed easily on the side of the belt on which the wet web is placed. The belt can be made flexible and more durable by the use of a mixture of fibers.

Figure 2:
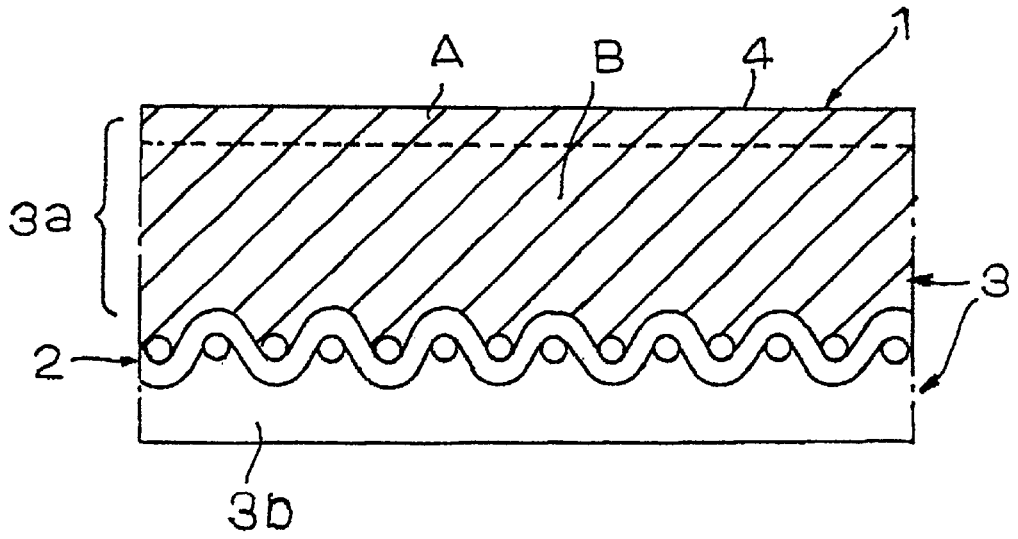
FIG. 2 is an enlarged cross-sectional view of a wet web transfer belt in accordance with a second embodiment of the invention, in which a meltable fiber is used in the entire part of the side of the belt on which a wet web is placed.

In the belt illustrated in FIG. 2, the entire side 3*a,* illustrated by cross-hatching, including not only the surface layer A but also the middle layer B of the batt layer 3 on which a wet web is placed, is made of a meltable fiber substantially by itself or of a mixture of meltable and non-meltable fibers. The roll contact side 3*b* is made of non-meltable fibers only. In this case, as in the case of the belt of FIG. 1, projections and concavities are formed on the surface when the meltable fiber in the surface layer A is welded by heat, forming a welded layer 4.

Figure 3:
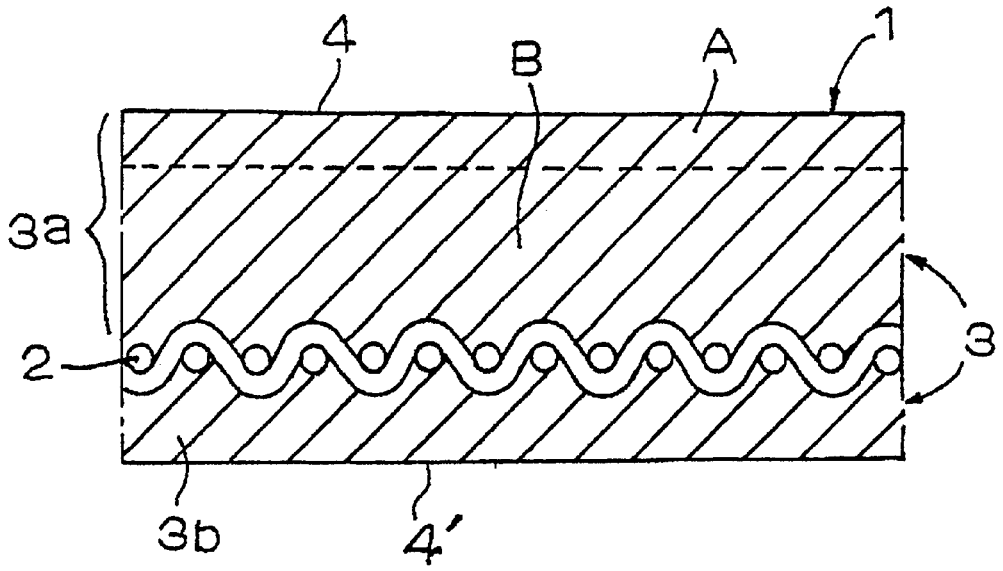
FIG. 3 is an enlarged cross-sectional view of a wet web transfer belt in accordance with a third embodiment of the invention, in which the entire batt layer is composed of a meltable fiber.

In the belt illustrated in FIG. 3, the entire side 3*a,* on which the wet web is placed, as well as the roll contacting side 3*b,* are composed of a meltable fiber or a mixture of a meltable and non-meltable fiber. In this case, as in the case of the belts of FIGS. 1 and 2, projections and concavities are formed on the surface when the meltable fiber in the surface layer A of side 3*a* is welded by heat to form a welded layer 4. Further, a welded layer 4' may be formed on the roll contacting side 3*b,* so that the air permeability of the roll contacting side can also be regulated.

Figure 4:
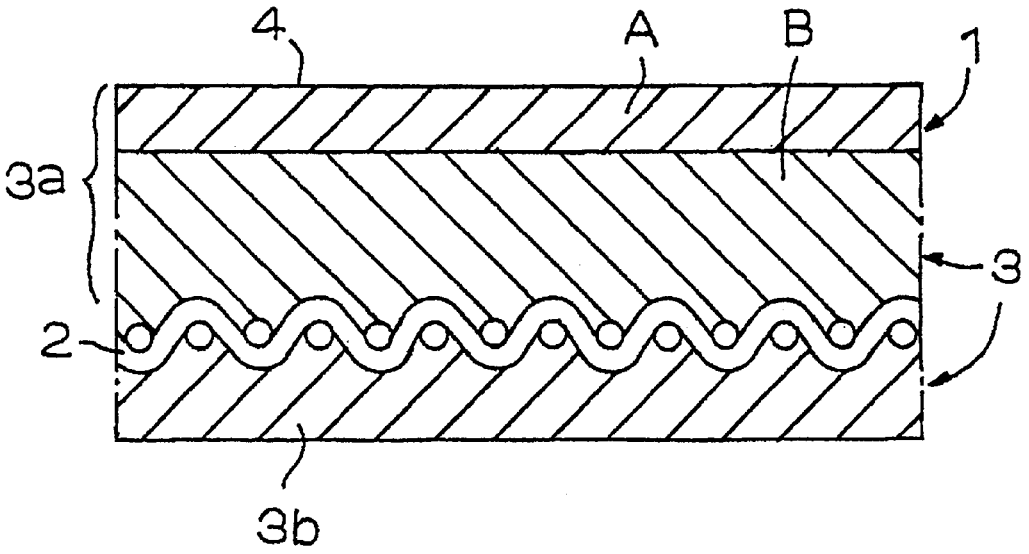
FIG. 4 is an enlarged cross-sectional view of a wet web transfer belt in accordance with a fourth embodiment of the invention, in which a meltable fiber is mixed, in different proportions, in each layer forming the batt layer.

In the belt illustrated in FIG. 4, meltable fiber and non-meltable fiber are mixed in different proportions in the surface layer A, the middle layer B of side 3*a* and the layer on the roll contacting side 3*b* respectively. These three layers are distinguished from one another in the drawing by cross-hatching in different directions. For example, the surface layer A, on which the wet web is placed, may be composed of 100% meltable fibers, whereas in the roll contacting side, meltable and non-meltable fibers can be present in a mixture consisting of 50% meltable fibers and 50% non-meltable fibers. In another example, meltable fibers and non-meltable fibers can be present in the ratio of 50% each in the surface layer A and the middle layer B, while in the roll-contacting side 3*b,* the mixture can consist of 80% meltable fibers and 20% non-meltable fibers.

If a greater proportion of meltable fiber is present in a mixture of meltable and non-meltable fibers, the belt becomes harder and more durable when the fibers are welded. On the other hand, with a lesser proportion of meltable fiber in the mixture, the belt can be made more flexible after welding, and therefore more easily installed. The proportion of meltable and non-meltable fibers may be determined by taking these factors into account.

In the embodiments of the belt according to the invention illustrated above, projections and concavities in the wet web-contacting surface of the belt are formed when the meltable fibers of the web-contacting layer are welded by heat to form a welded layer. The air permeability of the welded layer is preferably regulated so that it is not greater than 2 cc/cm$^2$/sec. Furthermore, since the projections and concavities of the welded layer greatly affect the ease with which a wet web is released after passing through a nip press, the surface roughness of the welded layer should be regulated at Rz5–80 $\mu$m.

The air permeability was measured by A method (fragile type testing machine) standardized in "JIS L 1096 (Testing Methods for Fabrics)", and surface roughness was measured by a method shown in "JIS B0601-1982".

Figure 5A:
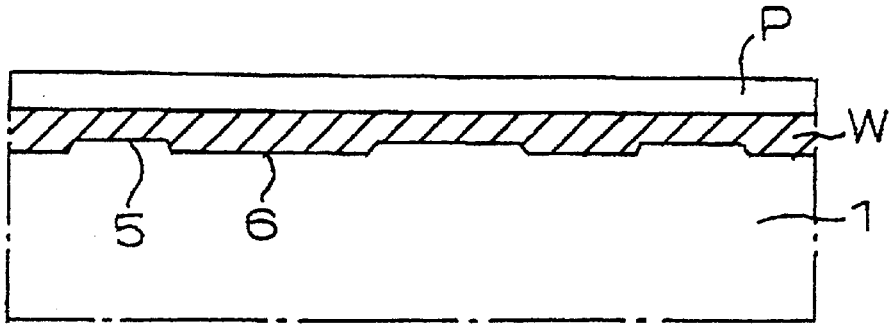
FIG. 5(*a*) is an enlarged cross-sectional view of a belt according to the invention, illustrating a wet web placed on the belt.
Figure 5B:
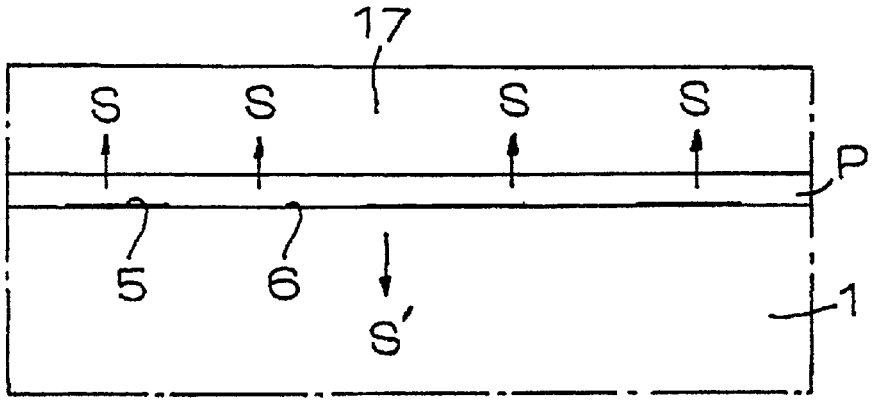
Figure 5C:
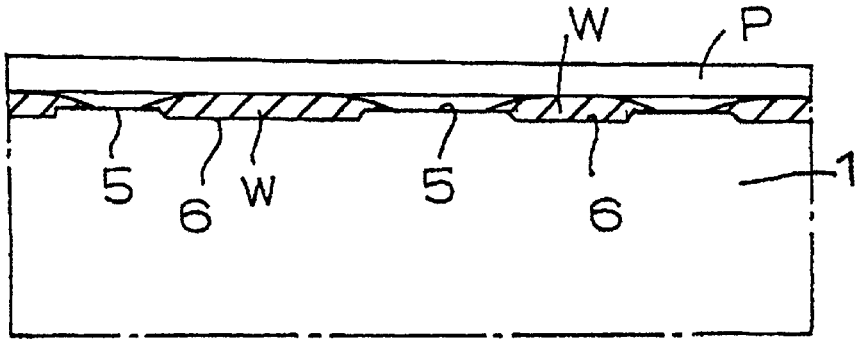

The effect of the belt according to the invention is illustrated in FIGS. 5(*a*)–5(*c*). As shown in FIG. 5(*a*), a wet web P is placed on the surface of the side 3*a* of the belt 1 having surface projections 5 and surface concavities 6, a water film W is formed between the surface of the belt and the wet web P by water drained from the wet web.

As shown in FIG. 5(*b*), when pressure is applied to the belt by a nip press consisting of a press roll and a shoe press (e.g. at nip location N2 in FIG. 9(*a*)) the projections 5 and concavities 6 are flattened because of the flexibility of the materials. Therefore, no markings are imparted to the wet web P by the projections and concavities. As shown by arrow S, water which is squeezed out of the wet web P by the nip press is caused to move into a press felt 17.

Since the air permeability of the belt is regulated at 2 cc/cm$^2$/sec or less, little water which is squeezed from the wet web P moves into the belt in the direction of arrow S'. Therefore, rewetting of the web when it is released from the nip press is prevented.

After release of pressure applied by the nip press, projections 5 and concavities 6 are restored on the surface of the belt. The water film W (illustrated by cross-hatching in FIG. 5(*c*)) is broken. Therefore the wet web P will not adhere to the surface of belt 1, and can be easily released by suction at a vacuum roll 18' (FIG. 9(*a*)) so that it adheres to canvas belt 18.

Figure 6:
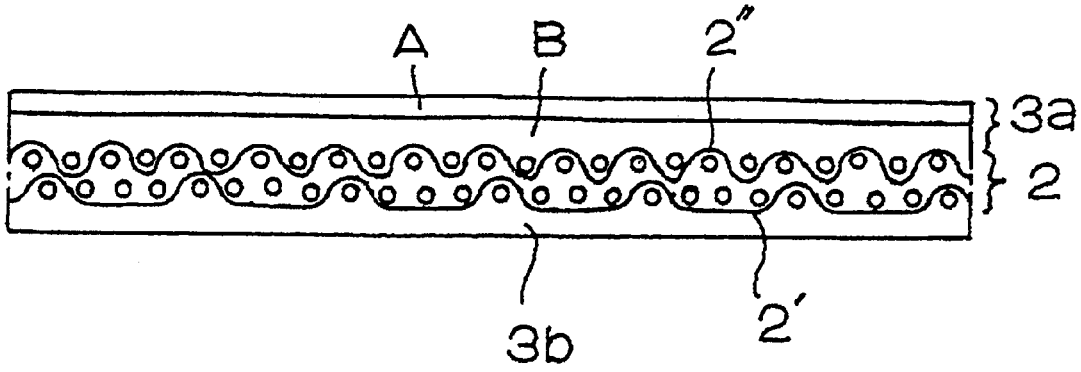
FIG. 6 is a schematic cross-sectional view of a basic form of belt for reference in the description of the working examples and comparative examples.

Referring to FIG. 6, a specific example of a wet web transfer belt in accordance is constructed as follows. A base layer 2 (600 g/m$^2$) was formed by piling a second (upper) ground fabric (200 g/m$^2$) 2" on a first (lower) ground fabric (400 g/m$^2$) 2'. In the upper ground fabric twisted yarns, made by twisting three monofilaments of nylon 6 (0.2 mm in diameter), were woven into a single plain weave as warp yarns and weft yarns. In the lower ground fabric, the same yarns were woven into an endless 3/1 broken weave. The roll contact side 3*b* was formed by needle-punching batt fibers (300 g/m$^2$) piled on the first ground fabric 2' of the base layer 2. Then the base layer was turned over, and the side 3*a,* on which a wet web is placed, was formed by piling and needle-punching the batt fibers of the middle layer B (300 g/m$^2$) and the surface layer A (300 g/m$^2$) on the second ground fabric 2". As will be described later, the side 3*a,* on which a wet web is placed, is composed substantially entirely of meltable fibers or of a mixture of meltable fibers and universal or heat-resistant fibers.

Thereafter, the side 3*a* was placed into contact with a press roll heated to 170° C., and heat was conducted deep into the belt. (As an alternative, the side 3*a* can be heated by blowing hot air onto it.) The meltable fiber was melted and welded by the heat, and became film-like to form a welded layer. The air permeability of the welded layer was regulated to be 2 cc/cm$^2$/sec or less.

Examples are compared in FIGS. 7 and 8. The table of FIG. 7 illustrates eight examples in which the meltable fiber was mixed at different ratios in the surface layer A, the middle layer B of the web-contacting side 3*a* of the batt layer, and in the roll-contacting side 3*b* respectively. In these eight examples, the density, air permeability and surface roughness were regulated as shown in the table. The table of FIG. 8 illustrates comparative examples. One comparative example, example 9, is a belt in which meltable fiber was not used in the web-contacting side. Comparative examples 10 and 11 are belts in which the air permeability was greater than 2 cc/cm$^2$/sec. Comparative example 12 is a conventional belt of a closed-draw papermaking machine.

The tables compare the performance of the belt in three aspects: weight (which affects ease of installation); rewetting; and ease of release. The symbol X indicates poor performance, Δ indicates fair performance, ○ indicates good performance and ◎ indicates excellent performance.

According to the tables, examples 1 and 2, wherein the surface of the web-contacting side 3*a* was composed of 100% meltable fibers, are evaluated as Δ (fair) in weight, which is worse than examples 3–8 and the comparative examples 9–11, but not as bad as the conventional belt of example 12, which is evaluated as X (poor).

Examples 1–3 are evaluated as ◎ (excellent) with respect to rewetting prevention, which is better than examples 4–8. Insofar as rewetting prevention is concerned, the comparative belts of examples 9–11 were evaluated as X (poor), but the conventional belt performed excellently (◎).

Insofar as releasability is concerned, examples 4–8 and the comparative belts 9–11 exhibited excellent performance (◎). Examples 1–3 and the conventional belt of example 12, functioned well (○).

In summary, from the tables, it will be apparent that examples 1–8 have no poor (X) evaluations insofar as weight, rewetting and releasability are concerned. On the other hand, each of the comparative belts has a poor (X) evaluation in one of the three categories. Thus belts of examples 1–8 are superior to the others as a whole.

As described above, the wet web transfer belt of the invention, in which at least a surface of the side of the batt layer on which a wet web is placed is formed by a meltable fiber, produces an excellent effect in that a rough surface can be formed on the belt with reliable quality by regulating heat applied in welding the meltable fiber or by regulating the proportion of meltable and non-meltable fibers. The belt can be made light in weight, and is superior in that it allows a wet web to be released easily in a closed-draw papermaking machine. Moreover, by regulating air permeability so that it is 2 cc/cm$^2$/sec or less, the belt can be formed so that it water squeezed out of the wet web can be kept from moving deep into the belt, and in this way rewetting of the web is effectively prevented.

What is claimed is:

1. A wet web transfer belt suitable for installation in a papermaking machine wherein a wet web is transferred in a closed draw, the belt comprising a base layer and a batt layer, the batt layer having a side on which a wet web is placed, wherein at least a surface of said side of the batt layer is formed of fiber comprising a welded layer of meltable fiber, wherein projections and concavities are formed on the surface of said welded layer of said meltable fiber due to a fibrous configuration, said projections and concavities being capable of flattening when a nip pressure is applied, wherein the welded layer has an air permeability of 2 cc/cm$^2$/sec. or less.

2. The wet web transfer belt according to claim 1 wherein said projections and concavities are formed by partly melting meltable fiber.

3. A wet web transfer belt according to claim 1, wherein the fiber forming said surface consists substantially entirely of a meltable fiber.

4. A wet web transfer belt according to claim 1, wherein the fiber forming said surface comprises a mixture of a meltable fiber and a non-meltable fiber.

5. A wet web transfer belt according to claim 1, wherein at least a part of said meltable fiber is meltable at a temperature in the range from 120° C. to 180° C.

6. A wet web transfer belt according to claim 1, wherein the welded layer has a surface roughness of Rz5–80 $\mu$m.

* * * * *